United States Patent [19]

Postupack et al.

[11] Patent Number: 4,762,595

[45] Date of Patent: Aug. 9, 1988

[54] ELECTROFORMING ELEMENTS

[75] Inventors: Dennis S. Postupack, Natrona Heights; Jean P. Pressau, Evans City, both of Pa.

[73] Assignee: PPG Industries, Inc., Pittsburgh, Pa.

[21] Appl. No.: 99,692

[22] Filed: Sep. 18, 1987

Related U.S. Application Data

[63] Continuation of Ser. No. 605,505, Apr. 30, 1984, abandoned.

[51] Int. Cl.[4] ..... C25D 1/08

[52] U.S. Cl. ..... 204/11

[58] Field of Search ..... 204/11, 192.1

[56] References Cited

U.S. PATENT DOCUMENTS

| | | | |
|---|---|---|---|
| 2,529,086 | 11/1950 | Taw | 204/192 C |
| 2,813,960 | 11/1957 | Egle et al. | 219/19 |
| 3,703,450 | 11/1972 | Bakewell | 204/11 |
| 3,833,482 | 9/1974 | Jacobus | 204/11 |
| 3,878,061 | 4/1975 | Feldstein | 204/11 |

FOREIGN PATENT DOCUMENTS

| | | | |
|---|---|---|---|
| 947224 | 5/1974 | Canada | 204/11 |

OTHER PUBLICATIONS

"A New and Unique Element for Aircraft Transparencies", by Olson et al. from the *Conference on Aerospace Transparent Materials and Enclosures,* Dec. 1983.

*Primary Examiner*—T. M. Tufariello

*Attorney, Agent, or Firm*—Donna L. Seidel

[57] ABSTRACT

A method for producing an electroforming mandrel is disclosed wherein a continuous conductive film is deposited onto a substrate, and a photoresist is deposited over the conductive film, exposed and developed to form a pattern on the conductive film whereupon a metal element is electroformed.

7 Claims, No Drawings

ELECTROFORMING ELEMENTS

This application is a continuation of U.S. Ser. No. 605,505 filed Apr. 30, 1984, by the same inventor and now abandoned.

BACKGROUND

The present invention relates generally to the art of electroforming, and more particularly to the art of electroforming a heating grid.

Electroforming of precision patterns, such as those used in optical systems, has been accomplished by several methods. For example, precision mesh patterns have been produced by electroplating onto a master pattern of lines formed by etching or ruling lines into a glass substrate and depositing a conductive material into the etched or ruled lines to form a conductive master pattern for electroplating. A major disadvantage of this method is the limitation on the fineness and precision of etching glass.

Photolithographic techniques have also been used to produce patterned electroforming mandrels. For example, a conductive substrate, such as a polished stainless steel plate, is coated with a layer of photoresist. A patterned photomask is placed over the photoresist, which is then exposed to actinic radiation through the mask, thereby creating a pattern of exposed and unexposed photoresist which is further developed. Either the exposed or the unexposed portions of the photoresist are removed, depending on whether a positive or negative pattern is desired, resulting in a conductive pattern on the substrate. An electroplating process is then carried out to form a replica of the conductive pattern which can thereafter be removed from the substrate. This method is also restricted in the uniformity and precision of lines which can be formed, as well as requiring reprocessing of the master pattern after limited usage.

U.S. Pat. No. 3,703,450 to Bakewell discloses a method of fabricating precision conductive mesh patterns on a repetitively reusable master plate comprising a conductive pattern formed on a nonconductive substrate and a non-conductive pattern formed in the interstices of the conductive pattern. A reproduction of the master pattern is formed by plating of a conductive pattern onto the master pattern within a matrix defined by the non-conductive pattern. The conductive metal master pattern is typically deposited onto a glass plate by evaporation of a metal such as chromium through a ruled pattern formed on a stencil material. The nonconductive pattern is formed by depositing a layer of photoresist over the conductive pattern coated side of the glass plate. By exposing the photoresist to actinic radiation through the conductive pattern coated substrate, exact registration of the conductive and nonconductive patterns is achieved. The photoresist layer is developed and the exposed portions are removed, leaving a pattern of photoresist over the conductive pattern. A silicon monoxide layer is then deposited over the entire surface of the glass plate, covering both the photoresist/conductive pattern coated portions and the exposed glass portions. Finally, the photoresist overlying the conductive pattern and the silicon monoxide overlying the residual photoresist material are removed, leaving the glass plate coated with a conductive metal pattern and an array of silicon monoxide deposits in the interstitial spaces in the conductive pattern. Replicas of the conductive pattern are then formed by electroplating.

SUMMARY OF THE INVENTION

The present invention provides an alternative process for producing a heater element grid. A substrate transparent to actinic radiation is provided with a desired pattern for the heater element grid to form a photomask. A substrate to be used as the electroforming mandrel is coated with a continuous conductive film. A continuous layer of photoresist is deposited over the conductive film. The photoresist is exposed to actinic radiation through the photomask, the pattern acting to mask portions of the photoresist from exposure. The photoresist is then developed, and the unexposed portions removed to yield a conductive pattern of the underlying conductive film corresponding to the pattern of the photomask. Alternatively, the exposed portions of the photoresist may be removed to yield a conductive pattern which is a negative image of the pattern of the photomask. The resultant article is employed as a mandrel for the electroforming of a metallic heater element grid. The mandrel is immersed in an electroforming solution, and current is applied to effect the electrodeposition of metal onto the conductive pattern area on the mandrel. When a sufficiently thick deposit is obtained, the remaining photoresist is removed, and the electroformed heating grid is separated from the mandrel.

DETAILED DESCRIPTION OF THE PREFERRED EMBODIMENTS

In a preferred embodiment of the present invention, a glass master plate is provided with a pattern representing the configuration of the heating grid to be produced by electroforming. While the pattern may be formed by a coating, a most preferred embodiment of the present invention utilizes a glass photomask to provide the pattern, preferably a glass photomask having a pattern formed by stain producing metal infused into the glass. Preferred techniques for producing stained glass photomasks are described in detail in U.S. Pat. Nos. 4,144,066 and 4,155,735 to Ernsberger, the disclosures of which are incorporated herein by reference.

A continuous conductive film is deposited on the surface of a substrate to be used as the electroforming mandrel. The conductive film may be a metal or an electroconductive metal oxide such as tin oxide or indium oxide. The conductive film may be deposited by any conventional coating technique such as vacuum deposition, cathode sputtering, chemical vapor deposition or pyrolytic coating techniques. In a most preferred embodiment of the present invention, a conductive film comprising indium oxide is deposited by magnetron sputtering. The conductive film is preferably deposited on a glass substrate. In a most preferred embodiment of the present invention, a conductive film is sputtered from a cathode comprising 80 to 90 percent indium and 10 to 20 percent tin.

A continuous layer of photoresist is applied over the conductive film. Any conventional photoresist with sufficient resolution is acceptable. In a preferred embodiment of the present invention, photoresist in sheet form is laminated to the conductive film. The photoresist is exposed to actinic radiation through the photomask to cure the exposed portions of the photoresist. The photomask pattern masks portions of the photoresist from exposure, and these portions remain uncured. Following exposure of the photoresist, and a post-curing cycle if necessary, the photoresist is developed.

Preferably, the photoresist is contacted with a chemical solution which dissolves and removes the unexposed, uncured portions of the photoresist, thereby providing a pattern of the underlying conductive film which is a positive image of the pattern in the photomask. The remaining exposed, cured portions of the photoresist surrounding the conductive pattern form walls within which the electroformed heating grid is subsequently deposited. In an alternative embodiment of the present invention a positive working photoresist may be employed to form a conductive film pattern which is a negative image of the photomask pattern.

The resulting article is employed as a mandrel for the electroforming of a metallic heating grid which is a replication of the pattern on the conductive film. In accordance with the present invention, the substrate bearing a conductive film having a pattern defined by the photomask pattern is contacted with a conventional metal-containing electrodeposition solution. An electrical circuit is established, using the conductive film as the cathode and an electrode of the metal to be deposited as the anode. An electrical potential is applied, and metal is deposited on the conductive film in the pattern defined by the nonconductive photoresist. Electrodeposition is continued until the desired thickness is obtained for the electroformed heating grid. The substrate bearing the conductive film, photoresist, and electroformed heating grid is removed from the electrodeposition solution. Separation of the electroformed heating grid from the mandrel may be effected by various means, such as alternately heating and chilling. In certain applications wherein the electroformed heating grid is very thin and/or comprises very fine lines, the remaining photoresist is first removed, preferably by dissolution. Then the electroformed part is lifted off the mandrel. In other applications, the electroformed part may be separated from the mandrel without removing the remaining photoresist, permitting immediate reuse of the mandrel. In most preferred embodiments of the present invention wherein the electroformed heating grid comprises very fine lines, a preferred method for separating the electroformed heating element from the mandrel is to remove the photoresist, contact the electroformed part with a polymeric material to which the part adheres, and remove the heating element attached to the polymeric material. Preferably, the polymeric material is an interlayer sheet to be laminated to a rigid sheet to form an aircraft transparency. In a most preferred embodiment, the polymeric material is a sheet of polyvinyl butyral, a surface of which is chemically treated to soften the surface. The tacky surface is used to pick the heating grid off the mandrel. The polyvinyl butyral sheet is then laminated to a second polymer sheet with the heating grid between them. Various solvents may be used to soften the polyvinyl butyral; diethylene glycol monobutyl ether is preferred.

The present invention will be further understood from the descriptions of specific examples which follow.

EXAMPLE I

A glass photomask is prepared by coating a glass plate with a photographic emulsion comprising silver halide which is exposed to actinic radiation through a master pattern in the shape of the part to be electroformed. Exposed areas of the photographic emulsion form a latent image which is developed by immersion in developing solutions which convert the silver halide to colloidal silver. The coated glass plate is subjected to an electric field which induces migration of the silver ions into the glass. The silver ions are reduced to elemental silver which agglomerates into colloidal, microcrystalline color centers which form a stained pattern within the glass which corresponds with the master pattern of the article to be electroformed. An electroforming mandrel is prepared by coating a glass substrate surface with a continuous conductive film by magnetron sputtering of a cathode comprising 90 percent indium and 10 percent tin. The preferred indium oxide film has a surface resistivity less than 20 ohms per square. A continuous layer of photoresist is applied over the conductive film by laminating a sheet of photoresist to the indium oxide at a temperature of 235° F. (about 113° C.). A photoresist layer having a thickness of 0.001 inch (about 0.025 millimeter) is available from Thiokol/Dynachem Corp. of Tustin, Calif. The photoresist is exposed to actinic radiation (Colight M-218) through the glass photomask for 20 seconds and cured. The photoresist is developed with a solvent which removes the unexposed portions of the photoresist thereby providing a pattern of the underlying indium oxide corresponding with the pattern in the photomask which in turn corresponds with the master pattern in the shape of the article to be electroformed. The resultant article is used as an electroforming mandrel in the following process.

EXAMPLE II

A glass mandrel 3 by 7 inches (about 7.6 by 17.8 centimeters) is prepared as in Example I having a screen pattern comprising lines 0.0012 inch (about 0.03 millimeter) wide spaced 0.022 inches (about 0.56 millimeters) apart. The mandrel is prepared for electroforming by sequential dipping into a dilute solution of hydrochloric and nitric acids, and isopropanol, each followed by a water rinse to clean and wet the electroforming surface. The glass mandrel is dipped into the electroforming solution several times to completely wet the surface and remove air bubbles before the electroforming process commences. The electroforming solution comprises nickel sulfamate, and is maintained at a temperature of 110° F. (about 43° C.). A cathode contact is applied to the indium oxide film of the glass electroforming mandrel. An anode contact is applied to a depolarized nickel plate. Both the mandrel and the plate are immersed into the nickel sulfamate solution. At a current density of 10 amps per square foot, electroforming proceeds at a rate of 0.001 inch (0.025 millimeter) per 100 minutes. When the electroformed part reaches the desired thickness, 0.0005 inches (about 0.013 millimeters), the mandrel is removed from the solution. The remaining photoresist is dissolved and removed with sodium hydroxide solution at 150° F. (about 66° C.). The electroformed heating grid is removed from the mandrel by contacting the surface with a sheet of polyvinyl butyral, the contacting surface of which has been treated with diethylene glycol monobutyl ether to produce an adhesive surface. As the polyvinyl butyral sheet is pulled away from the mandrel, the grid remains attached to the tacky surface of the polyvinyl butyral. To form a heatable interlayer, the polyvinyl butyral sheet bearing the heating grid is laminated to another polymeric sheet with the heating grid between the sheets.

EXAMPLE III

An optical grid is produced by electroforming as in Example II, except that the conductive pattern on the mandrel comprises finer lines more closely spaced. An optical grid is produced comprising lines 0.001 inch (about 0.025 millimeter) wide spaced 0.003 inch (about 0.076 millimeter) apart.

The above examples are offered to illustrate the present invention. Various modifications are included within the scope of the present invention. For example, metallic substrates may be used for the electroforming mandrel, and other metals may be deposited by electroforming, such as copper, iron, lead, tin and zinc. The electroformed elements of the present invention need not be grid patterns, but may be produced in any shape or configuration, limited only by the artwork. The scope of the present invention is defined by the following claims.

We claim:

1. A method for producing an electroforming mandrel comprising the steps of:

a. providing a glass substrate which transmits actinic radiation with a masking pattern in the form of a stain pattern within the glass which masks the transmission of actinic radiation to form a photomask;

b. depositing on a surface of a second substrate a continuous conductive film;

c. depositing on the conductive film a continuous layer of a photoresist;

d. exposing said photoresist to actinic radiation through said photomask; and e. developing said photoresist to selectively remove a portion thereof in order to uncover a pattern of the underlying conductive film which corresponds with the pattern of the photomask to produce an electroforming mandrel whereupon metal is deposited on the uncovered pattern of the conductive film.

2. A method according to claim 1, wherein the substrate for the electroforming mandrel is glass.

3. A method according to claim 2, wherein the conductive film is selected from the group consisting of indium oxide, tin oxide and mixtures thereof.

4. A method according to claim 3, wherein the conductive film is deposited by magnetron sputtering.

5. A method according to claim 4, wherein the photoresist is applied by laminating a sheet of photoresist to the conductive film.

6. A method according to claim 5, wherein the photoresist is developed by contacting it with a solvent which removes the unexposed portions of the photoresist.

7. A method according to claim 1, wherein the substrate for the electroforming mandrel is metallic.

* * * * *